United States Patent [19]

Rusk et al.

[11] 4,014,090

[45] Mar. 29, 1977

[54] PATTERN PLATES AND METHOD OF MAKING SAME

[75] Inventors: Gerald R. Rusk, Maumee, Ohio; Robert E. Koch, Ottawa Lake, Mich.

[73] Assignee: The Freeman Supply Company, Toledo, Ohio

[22] Filed: Mar. 10, 1975

[21] Appl. No.: 556,792

Related U.S. Application Data

[60] Continuation of Ser. No. 416,099, Nov. 23, 1973, abandoned, which is a division of Ser. No. 257,930, May 30, 1972, Pat. No. 3,789,912.

[52] U.S. Cl. ..... 29/527.4; 29/530; 76/107 R; 90/11 C; 164/45; 264/254; 264/267; 264/273

[51] Int. Cl.[2] ..... B22D 11/126; B23C 3/13

[58] Field of Search ..... 408/1, 115; 164/45, 164/98, 241, 243; 76/107 R; 29/527.5, 527.4, 527.6, 530, 558, 527.1, 527.5; 90/11 C; 144/325; 264/254, 267, 273

[56] References Cited

UNITED STATES PATENTS

| | | | |
|---|---|---|---|
| 2,186,799 | 1/1940 | Boker | 76/107 |
| 2,399,373 | 4/1946 | Miller | 164/13 |
| 3,213,496 | 10/1965 | Waite | 164/45 X |
| 3,437,307 | 4/1969 | Atwater | 164/98 X |
| 3,472,311 | 10/1969 | Rusk | 164/243 |

*Primary Examiner*—Francis S. Husar
*Assistant Examiner*—John S. Brown
*Attorney, Agent, or Firm*—William P. Hickey

[57] ABSTRACT

Method of producing plates having an identical configuration of valleys and lugs thereon so that one plate is interchangeable with another. Flat plates are provided with a pair of individual holes at opposite ends of the plate center line. Thereafter one or more valleys are machined in a predetermined spacing and location from one or both of the locating holes, and the process repeated for a plurality of plates. Lugs are produced by matching one plate with another by means of pins inserted into the locating holes, and injecting a hardenable material into the valleys. This hardenable material is bonded to the opposite plate. The machining operation of the valleys is carried out in a manner to produce randomly spaced ridges along the side surfaces of the valleys which form depressions in the side surfaces of the lugs that are cast therefrom. Molds made from the respective pattern plates have valleys with ridges therein which have an interference fit with respect to lugs of a matching mold.

13 Claims, 9 Drawing Figures

PATTERN PLATES AND METHOD OF MAKING SAME

This is a continuation of application Ser. No. 416,099, filed Nov. 23, 1973, now abandoned; and which in turn is a division of application Ser. No. 257,930, filed May 30, 1972, now U.S. Pat. No. 3,789,912.

BACKGROUND OF THE INVENTION

In the Carl F. Waite et al U.S. Pat. No. 3,213,496 there is disclosed a method whereby the bottom surface of one pattern plate is accurately made to dovetail or match with the top surface of another pattern plate using machined surfaces, which are not precisely located. In the procedure taught by the Waite et al patent, the top and bottom pattern plates are abutted and a hardenable material is injected into each valley and is bonded to the abutting surface of the other pattern plate to produce lugs thereon. In the Waite et al design a great number of valleys are required to be machined and the pattern plates can only be economically produced by performing the machining operations quickly without starting and stopping the machining operations in precise locations. While it might be possible for an operator of a milling machine to produce a second pattern plate having the exact length, arrangement, and spacing of valleys which were produced in a first pattern plate of the Waite et al design, it would be an extremely time consuming, tedious and a very expensive operation. All of the pattern plates which are produced by the Waite et al procedure therefore have a more or less random arrangement of valleys and lugs therein, and each pattern plate will only match the pattern plate from which its lugs were cast. When one of the matching pattern plates of the Waite et al patent is damaged, the remaining pattern plate is useless.

In the Rusk et al, U.S. Pat. No. 3,472,311 there is disclosed a pattern plate having valleys and lugs in the top surface which are directly opposite matching lugs and valleys in its bottom surface, so that the parts made from the bottom surface will exactly match parts made from the top surface. Parts can be made therefore from both the top surface and the bottom surface of a single pattern plate, but in order to accomplish this, the top and bottom surfaces of the same pattern plate must be very accurately laid out and produced. Pattern plates of such a design can only be made economically if the pattern plates are cast from a master copy. This dictates that pattern plates having usable top and bottom surfaces can only be made economically by a casting process, and that the accuracy of the pattern plates so produced is limited to the accuracy of a casting operation. Casting processes always involve shrinkage, and shrinkage in turn produces a cast part which is different from the master part by several thousands of an inch at best. Two pattern plates produced from the same master therefore will have a clearance therebetween of twice the shrinkage that is involved in the casting operation. It goes without saying, therefore, that a cast plate can never exactly duplicate the configuration of the master plate.

An object of the present invention is the provision of a new and improved inexpensive pattern plate configuration and process for producing the same, whereby a plurality of pattern plates can be produced which are so precisely alike that the parts made from one pattern plate precisely match with those produced from another pattern plate.

Another object of the invention is the provision of a new and improved method of producing pattern plates of the above described type wherein the parts which are produced from one pattern plate will actually have an interference fit with respect to the parts produced from another one of the pattern plates.

A further object of the invention is the provision of a new and improved pattern plate configuration and method of machining the same whereby the valleys that are machined in one pattern plate can be quickly duplicated in another pattern plate without requiring time consuming set up time of a milling machine.

Further objects and advantages of the invention will become apparent to those skilled in the art to which the invention relates from the following description of the preferred embodiments described with reference to the accompanying drawings forming a part of this specification.

DESCRIPTION OF THE PREFERRED EMBODIMENTS

Figure 1:
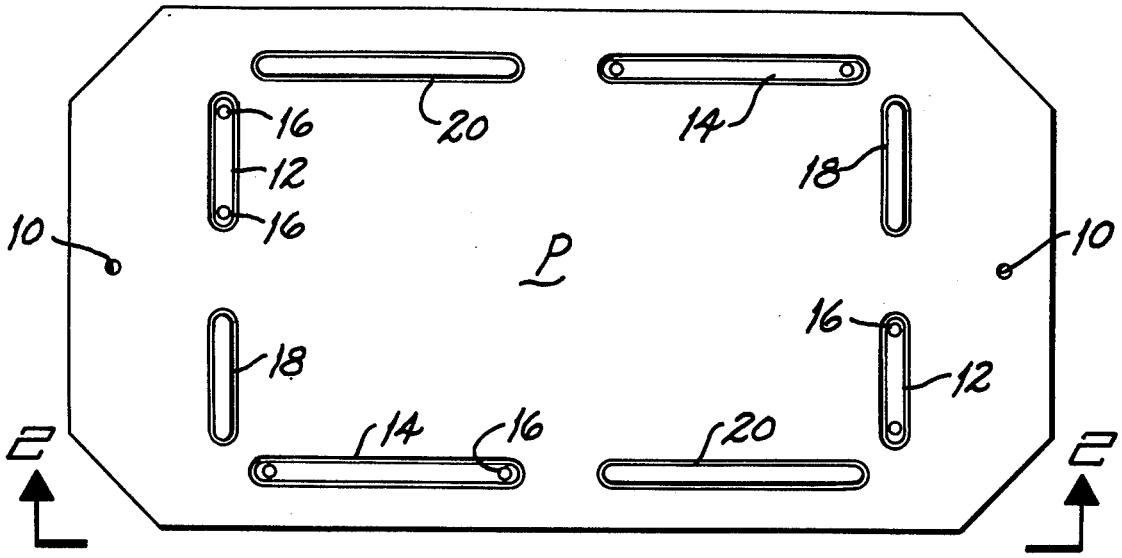
FIG. 1 is a plan view of a pattern plate embodying principles of the present invention.
Figure 2:
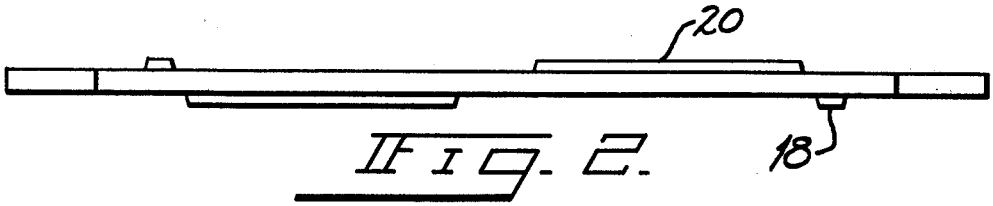
FIG. 2 is a side view of the pattern plate shown in FIG. 1.
Figure 3:
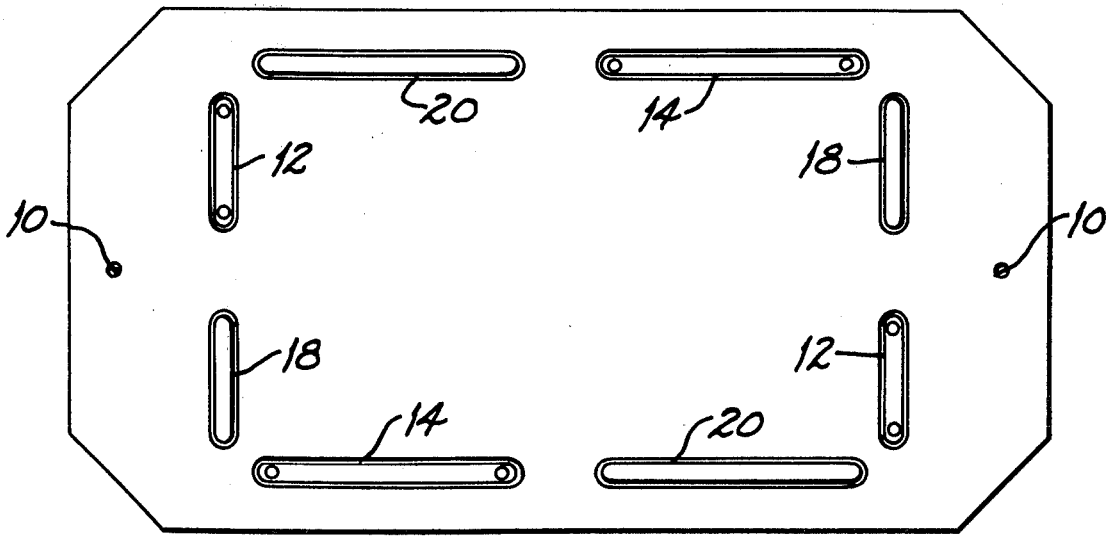
FIG. 3 is a bottom view of the pattern plate shown in FIGS. 1 and 2.

According to the present invention, an inexpensive and quickly performable process is provided for machining the top surface of a plurality of plates in a precise and identical manner, so that all of the parts molded from one pattern plate exactly match those molded from another pattern plate. According to the invention this is accomplished by machining as by drilling a pair of holes 10 in a precise spacing in each of the pattern plates, as can be done for example with a pair of spaced drilling arbors which are kept a precise distance apart. The upper surface of these pattern plates "P" are then machined to provide a plurality of transverse valleys 12 therein, which are accurately located relative to the holes 10. The machining operation can be performed in a number of ways, one of which is by a milling machine. In the case of a milling machine, the operation is easily accomplished by installing pins on the bed of the machine to receive the openings 10 of each plate. The milling cutter is centered on one of the openings 10 and the bed of the milling machine is thereafter moved a precise X and Y distance to bring the cutter at the beginning location for the milling operation. The starting location for the milling cutter can also be quickly arrived at by a fixture attached to the head of the milling cutter, which fixture has a pin fixed thereto for entering the upper end of the adjacent hole 10 when the milling cutter is in the proper X and Y dimension from the hole 10. As shown in FIG. 1 of the drawings, a valley 12 is adjacent the left side of the plate and the starting position for milling this valley is quickly arrived at by moving the bed of the milling machine by a precise plus X and a precise minus Y direction as accurately determined by the micrometer dial on the lead screw of the bed of the milling machine. The milling is accomplished by moving the bed in a minus Y direction by a precise distance which can be automatically stopped by a limit switch on the micrometer dial of the machine. Thereafter the milling cutter is raised and the pattern plate is lifted off of the pins on the bed of the milling machine. The pattern plate is then rotated end for end to bring the opposite locating hole 10 in register with the locating pin previously used. Thereafter the valley 12 adjacent the right hand edge of the plate as seen in FIG. 1 is machined by moving the bed of the milling machine in a positive Y direction to bring the bed back to its starting position. This process is thereafter repeated for all of the pattern plates.

After a plurality of pattern plates has been machined to provide transverse valleys 12 adjacent the ends of the plates, the bed of the milling machine is moved in a precribed X and Y direction from the locating hole 10 to bring the milling cutter in a starting position for machining the longitudinal valleys 14. This can be done by using the micrometer on the lead screw of the bed of the milling machine, or by another fixture attached to the head of the milling machine having a pin which is just received in the adjacent hole 10 when the cutter is in the proper position. Thereafter the cutter is lowered and the bed of the milling machine is moved in a minus X direction by a precise predetermined distance to machine a valley 14. This movement can be terminated by a suitable limit switch. The head of the milling machine is then raised and the plate is again switched end for end to reverse the engagement of the locating holes 10 with the locating pins on the bed of the machine. Thereafter the bed of the milling machine is moved in a positive X direction to machine the opposite valley 14. This process is also repeated for the plurality of plates. It will now be seen that the operation of the milling machine is for the most part a simple automatic back and forth movement, since the pattern plates are accurately located relative to the milling cutter rather than the milling cutter being accurately repositioned to each pattern plate.

Two holes 16 are drilled through each plate to communicate the valleys 12 and 14 with the opposite side of the plate. These openings 16 need not be precisely located or sized. Thereafter, the bottom surface of one of the plates thus machined is matched against or superimposed on the machined top surface of another one of the pattern plates and is alligned by inserting locating pins through the superimposed openings 10. Thereafter a suitable hardenable plastic is inserted through the openings 16 to fill the valleys 12 and 14 on the top surface of the other plate to produce matching lugs 18 and 20 that are bonded to the top plates by reason of the plastic which hardens in the openings 16. In order to further lock the cast plastic lugs 18 and 20 to the bottom surface of the top pattern plate, the bottom surface of the top pattern plate is preferably provided with shallow grooves 22, which need not be precisely machined, and which can be made in a manner similar to that above described for the valleys 12 and 14.

The process so far described produces valleys 12 and 14 in the top surface of the pattern plates, and lugs 18 and 20 on the bottom surface of the pattern plates which accurately match each other. Because these valleys are precisely machined and are in identical positions in all of the pattern plates, the lugs of one pattern plate will fit the valleys of any of the other pattern plates. The parts produced from the top surface of any one of the pattern plates will therefore fit the molds produced from the bottom surfaces of any of the other pattern plates.

While plates having all valleys on one side, and all lugs on the other, will be acceptable in many instances, the preferred pattern plate shown in the drawings contains both lugs and valleys on each side of the plate. In the preferred embodiment shown in the drawings the valleys on the bottom surfaces have the identical configuration as do the valleys 12 and 14 on the top surfaces and are so numbered. The lugs on the top surface have the identical configuration as the lugs 18 and 20 on the bottom surfaces and are so numbered, and the lugs on one side of the plate are directly opposite corresponding valleys on the opposite side of the plate. With this arrangement, the lugs 18 and 20 on the top surface of the pattern plate are produced without making any further adjustments of the milling machine. This is accomplished by machining valleys in the bottom surface of each pattern plate in the identical manner as were the valleys 12 and 14 in the top of each pattern plate. This is accomplished by lifting each plate off of the alignment pins and rotating the plate about its longitudinal axis to bring the bottom surface on top for the precise same milling operation. The plate is thereafter lowered to bring the pins into the openings 10. A valley 12 is then machined therein. The pattern plate is then turned end for end, and the opposite valley 12 machined. A similar operation is used to machine the valleys 14 in the bottom of the plates. Thereafter the bottom surface of one plate is abutted with the top surface of another plate and the lugs 18 and 20 are cast onto the top surface of the other plate. It will now be seen that the top and bottom surfaces of all of the pattern plates are identically machined by using but two starting settings for the milling cutter.

Still other methods of machining the pattern plates may be found, but regardless of the operation that is used, the pattern plates of the present invention require a minimum of layout for the machining operations. Because the bottom configuration of each plate is exactly the same as the top configuration of each plate, articles cast from the bottom of any plate will fit the top surface of any other plate. In addition, the pattern plates will match each other when turned end for end or rotated about the longitudinal center line, as will the parts produced therefrom. The preferred pattern plates of the present invention therefore are unique in many ways, and the principles of the present invention are applicable regardless of the number of lugs and valleys that are used in the pattern plate design.

Figure 4:
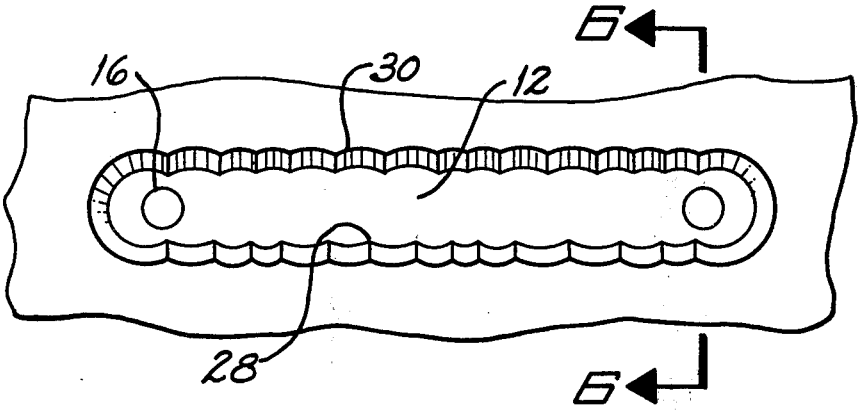
FIG. 4 is a fragmentary plan view of a typical valley provided in the top and bottom surfaces of the pattern plates shown in FIGS. 1 through 3.
Figure 5:
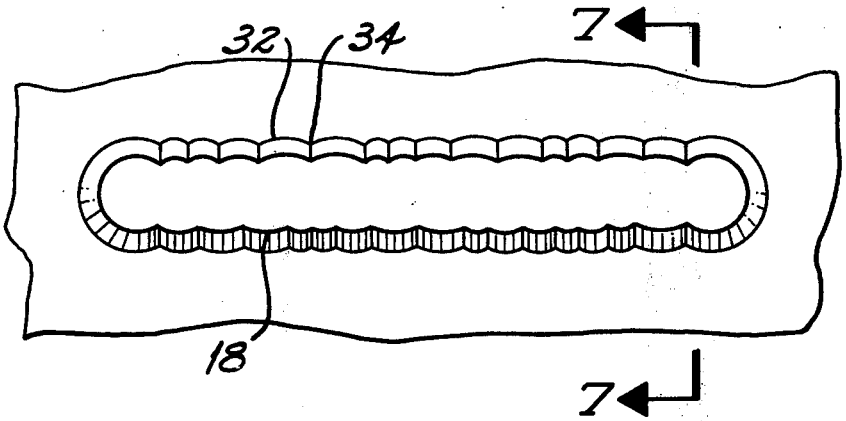
FIG. 5 is a fragmentary plan view of a typical lug shown in the top and bottom surfaces of the pattern plates shown in FIGS. 1 through 3.

According to a further principle of the present invention, the machining of the valleys is done with an irregular small side to side movement of the milling cutter away from a side stop to produce ridges 28 as shown in FIG. 4. This is easily accomplished as will be understood by those skilled in the art by moving a micrometer dial away from and against a stop. These ridges are spaced apart by the depressions 30, and the bottoms of the depressions are in line as determined by the stop to form the basic contour of the valley. The ridges 28 have a depth determined by the movement of the milling cutter away from the stop, and preferably have a height of approximately 0.0003 to 0.0006 inch.

A pair of micrometer stops set apart by this distance can be used to hold the bottom of the depressions 30 in line on both sides of the valley. The machining can be done by merely turning the micrometer dial between these two stops while machining in a single direction. When the valleys are to be made wider than the diameter of the milling cutter plus the height of the ridges, the micrometer dial can be moved against and away from one stop while milling in one direction until the end of the valley is reached, followed by stopping the feed and moving the micrometer to the oppostie stop. Thereafter the feed of the cutter is reversed and the micrometer dial is moved against and away from the opposite stop by an amount corresponding to the height of the ridges until the cutter returns to its starting position.

Figure 8:
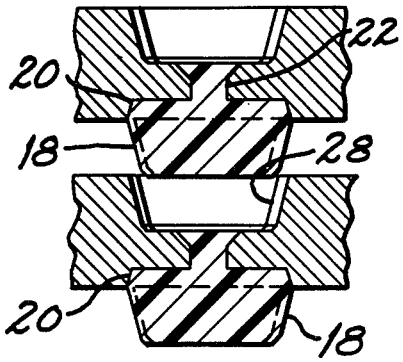
FIG. 8 is a telescoping view of the fragmentary sections shown in FIGS. 6 & 7 and showing how the fragmentary elements have an interference fit when matched with each other.
Figure 7:
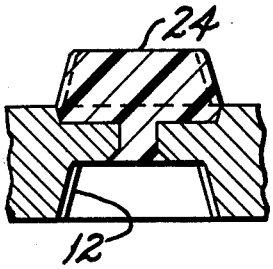
FIG. 7 is a fragmentary sectional view taken approximately on the line 7–7 of FIG. 5.
Figure 6:
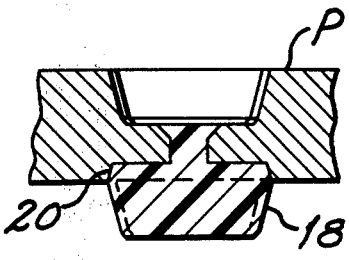
FIG. 6 is a fragmentary sectional view taken approximately on the line 6—6 of FIG. 4.
Figure 9:
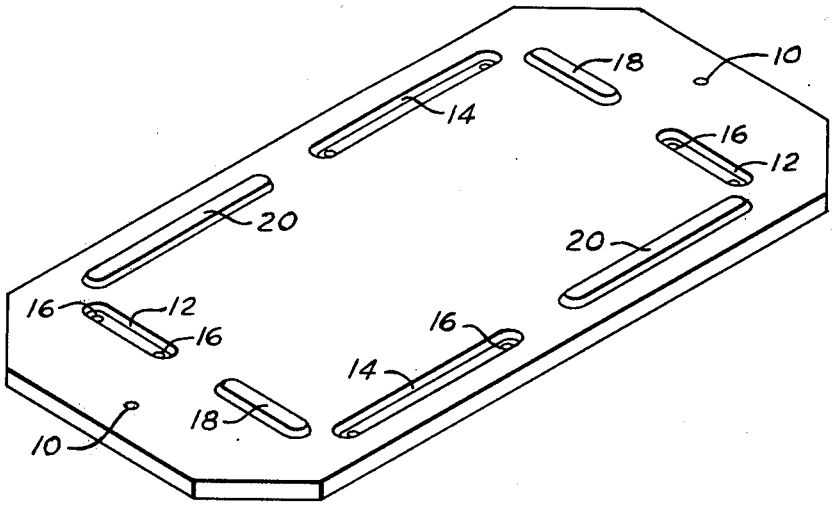

It will now be seen that when the lugs are cast from valleys having the ridges 28 therein, raised areas 32 are produced in the lugs corresponding to the depressions 30, and grooves 34 are formed corresponding to the ridges 28. It will further be seen that the ridges 28 of each valley will never coincide with the ridges of another valley, since the ridges are made by random and irregular movement. Likewise the ridges of a part molded from one plate will not match the grooves in a lug molded from another plate; and so that the ridges of molded parts engage raised areas 32 of other molded parts when matched therewith. In FIG. 8 there is shown matching pattern plates wherein the lug 18 in the bottom of the top plate is in a telescoping position with respect to the valley 12 of the bottom pattern plate. The view shows the type of interference fit which the ridges 28 have with the raised areas 32. The sand molds made from the pattern plates are only used once and the ridges 28 of these molds are deformed by the raised areas 32 of a matching mold to provide a precise fit that does not allow any relative movement whatsoever. What is more, this arrangement allows the parts having the interference fit to be pressed together without cracking the molded sand, since grooves 34 are positioned laterally from each ridge 28 to receive the crushed sand.

It can now be seen that the objects heretofore enumerated as well as others have been accomplished, and that there has been provided a pattern plate design and a method of producing the same whereby identical pattern plates can be produced at a cost that is no greater than the cost of producing the pattern plates of the prior art.

While the invention has been described in considerable detail, we do not wish to be limited to the particular embodiments shown and described and it is our intention to cover hereby all novel adaptations, modifications, and arrangements thereof which come within the practice of those skilled in the art to which the invention relates.

We claim:

1. A method of producing a plurality of pattern plates having generally flat and parallel opposing faces each face of which has an imaginary center line formed by the intersection with said faces of an imaginary plane that is perpendicular to said faces, said method comprising: forming a valley in a first face of a first plate which valley has opposing side surfaces that are defined by concave surface indentations with the bottom of said indentations being aligned so that the cross section of the valley as defined by the aligned bottoms is an isosceles trapezoid, said side surfaces having ridges between the indentations which are irregularly spaced, forming a valley in the portion of the second face of the first plate as presented by rotation of the plate about a center line in the identical position as the valley in said first face and with an identical shape excepting that the ridges thereof do not correspond in position to those in said first face, repeating the forming steps in a number of plates, abutting the first face of a second plate with the second face of the first plate and with the center lines of the abutting faces in precise register so that the abutting face of one plate has a valley cover area overlying the valley in the abutting face of the other plate, providing a passageway communicating each valley or its cover area to an external plate surface, injecting a hardenable material through the passageways of the abutting plates into the valleys of the abutting faces and bonding the hardenable material onto the plate which covers the respective valleys, separating said plates, abutting the second face of the second plate with the first face of another plate and with the center lines of the abutting faces in precise register so that the abutting face of one plate has a valley cover area overlying the valley in the abutting face of the other plate, said plates having a passageway communicating each valley or its cover area to an external plate surface, injecting a hardenable material into the valleys of the abutting faces of said second and other plates and bonding the cast material onto the plate which covers the respective valley, and whereby objects cast from opposite sides of said plates have lugs with convex projections and have valleys with ridges in their side surfaces which projections and ridges engage each other when the objects are matched.

2. A method of producing pattern plates by the machining of blank plates having generally flat and parallel opposing faces each face of which has an imaginary center line formed by the intersection with said faces of an imaginary plane that is perpendicular to said faces, machining a valley in a first face of a first plate which valley has a cross section that is an isosceles trapezoid, machining a valley in the portion of the second face of the first plate as presented by rotation of the plate about a center line in the identical position from said center line as the valley in said first face and with an identical shape, repeating the machining steps in a number of plates, providing a passageway in each plate, which passageway extends from said valley to the opposite face of said plates, abutting the first face of a second plate with the second face of the first plate and with the center lines of the abutting faces in precise register, injecting a hardenable material through the passageways of said plates into the valleys of the abutting faces and bonding the cast material onto the plate which covers the respective valley, separating said plates, abutting the second face of the second plate with the first face of another plate and with the center lines of the abutting faces in precise register, injecting a hardenable material through the passageways of said plates into the valleys of the abutting faces and bonding the hardenable material onto the plate which covers the respective valley, and whereby objects cast from a first side of one of said plates have projections which precisely match the valleys of the second side of any other of said plates.

3. A method of producing a plurality of identical plates comprising: providing a blank plate having generally flat and parallel faces each face of which has an imaginary center line formed by the intersection with the face of an imaginary plane that is perpendicular to the faces, machining a pair of widely spaced apart round holes in precise spacing on said center line of said adjacent plate, opposite ends thereof machining a first valley in a first face of said first plate in a precise predetermined location from one of said holes, machining a second valley in said first face of said first plate in the same precise predetermined location from the other of said holes, and whereby duplicate plates can be produced by machining identical holes in another plate and machining valleys in precise locations from these holes.

4. The method of claim 3 including the steps of: providing a second plate generally corresponding to said first plate, machining a pair of widely spaced apart holes on the center line of a second face of the second plate identically spaced to those of said first plate, machining a valley in the second face of said second plate in said precise predetermined location from one of said holes as was said first valley, machining a valley in said second face in said precise predetermined location from the other of said holes as was said second valley, matching said second face with said first face of said first plate by placing tightly fitting pins through the holes in said plates as aligned so that the matching face of one plate has a valley cover area overlying the valley in the matching face of the other plate, providing a passageway communicating each valley or its cover area to an external plate surface, and injecting a hardenable material through said passageways into the valleys of the matched plates and hardening the material to the plate covering the valley, whereby objects cast from said second plate will precisely mate with said first face of said first plate.

5. The method of claim 4 wherein the sidewalls of said valleys are formed by side-to-side movement of a cutter as it traverses the length of the valleys to provide randomly spaced ridges and depressions therein

6. The method of claim 3 including the steps of: duplicating said steps to provide a plurality of said plates having identically machined first faces, matching the second face of one plate with said first face of another of said plates by placing tightly fitting pins through aligned holes in said plates so that the matching face of one plate has a valley cover area overlying the valley in the matching face of the other plate, providing a passageway communicating each valley or its cover area to an external plate surface, injecting a hardenable material through said passageways leading to the valleys of said other of said plates and bonding the hardenable material to the second face of said one of said plates, and whereby said second face of said first plate accurately mates with the first face of any of said plates.

7. The method of claim 3 including the steps of: causing said holes to extend through the plate, rotating said first plate about its center line to expose the opposite end of said holes therein, machining a valley in said second face in the precise predetermined location from said one of said holes as was said first valley, and machining another valley in said second face in the precise predetermined location from said other hole as was said second valley to provide identical configurations on opposite sides of the plate, and whereby objects cast from one side of the plate will fit the opposite side of the plate.

8. The method of claim 7 including the steps of: duplicating the machining operations in plates, providing passageways in each plate extending from said valleys to the opposite face of the plate in which the valleys are located, matching the first face of said first plate with the second face of another plate, placing tightly fitting pins in the aligned openings, injecting a hardenable material through said passageways into the valleys of the matching surfaces and hardening the material to the plates covering the valleys, matching the second face of the first plate with the first face of another plate, placing tightly fitting pins in the aligned openings, and injecting a hardenable material through said passageways leading to the valleys of the matching surfaces and hardening the material to the plates covering the valleys, whereby plates having identical first and second sides are produced.

9. The method of claim 8 wherein the sidewalls of said valleys are formed by side-to-side movement of a cutter as it traverses the length of the valleys to provide randomly spaced ridges and depressions therein.

10. A method of producing a plurality of pattern plates having identical configuration of valleys therein comprising: providing a plurality of blank plates having first and second generally flat and parallel opposite faces, providing a pair of widely spaced holes between said first and second opposite faces of each plate with respective holes being adjacent respective ends of the plate. Machining a first valley in the first face of each plate in a predetermined location relative to one of said holes, machining a second valley in the first face of each plate in said predetermined location relative to the other of said opeinings, machining a third valley in the second face of each plate in said predetermined location relative to said one of said openings, and machining a fourth valley in the second face of each plate in said predetermined location from said other opening, and whereby a pattern plate is made whose both sides are precisely identical.

11. The method of claim 10 comprising: abutting the first face of one plate against the second face of another of said plurality of plates so that the abutting face of one plate has a valley cover area overlying the valley in the abutting face of the other plate, providing a passageway communicating each valley or its cover area to an external plate surface, aligning said holes in said superimposed plates, and injecting a hardenable material into the valleys in said abutting surfaces through said passageways to provide projections on one plate which precisely fit into valleys of the other of said plates to be capable thereafter of accurately aligning any one of said plates with any other of said plates.

12. The method of claim 11 wherein: said hardenable material shrinks by a predetermined amount when it hardens in a valley, and said machining steps provide said side surfaces of said valleys with randomly spaced surface irregularities therein comprising projections and depressions, the projections of which have a height that is greater than said amount of shrinkage of said hardenable material; and whereby an interference fit occurs between a projection and a valley of superimposed plates other than the plate whose valley was used to form the projection initially.

13. A method of producing cast lugs of a material which shrinks during hardening and which provides an interference fit between parts reproduced therefrom, comprising: providing first, second, third and fourth plate areas having abuttable surfaces, machining a valley in the first plate area which valley has spaced apart ridges in its side surfaces which have a height slightly greater than the amount of shrinkage of the hardenable material during hardening, abutting said first and second plate areas, providing one of said first and second plate areas with a passageway extending between said valley or the overlying surface of said second plate area to an external surface, injecting a hardenable material through said passageway into said valley to form a first lug, machining a valley in the third plate area of the same outside dimensions as said valley of said first plate area and which valley has spaced apart ridges in its side surfaces which have a height comparable to those of said first mentioned valley but with a different orientation, abutting said third and fourth plate areas, one of said third and fourth areas having a passageway extending between said valley or the overlying surface of said fourth plate area to an external surface, injecting a hardenable material through said passageway into said valley to form a second lug, and whereby said second lug has an interference fit with the ridges of the valley in said first plate area and said first lug has an interference fit with the ridges of said third plate area.

* * * * *